US009837010B2

(12) United States Patent
Park et al.

(10) Patent No.: US 9,837,010 B2
(45) Date of Patent: Dec. 5, 2017

(54) DISPLAY APPARATUS OUTPUTTING SCAN SIGNALS IN FIRST AND SECOND MODE

(71) Applicant: Samsung Display Co., Ltd., Yongin (KR)

(72) Inventors: Nari Park, Yongin (KR); Youngseob Kim, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 180 days.

(21) Appl. No.: 14/664,271

(22) Filed: Mar. 20, 2015

(65) Prior Publication Data

US 2016/0118023 A1 Apr. 28, 2016

(30) Foreign Application Priority Data

Oct. 24, 2014 (KR) ..... 10-2014-0145395

(51) Int. Cl.
*G09G 5/00* (2006.01)
*G09G 3/20* (2006.01)

(52) U.S. Cl.
CPC ..... *G09G 3/20* (2013.01); *G09G 2310/0267* (2013.01); *G09G 2310/0275* (2013.01); *G09G 2310/0286* (2013.01)

(58) Field of Classification Search
CPC ..... G09G 3/20; G09G 2310/0267; G09G 2310/0275; G09G 2310/2086
See application file for complete search history.

(56) References Cited

U.S. PATENT DOCUMENTS 6,590,553 B1 * 7/2003 Kimura ..... G09G 3/3651 345/204
7,593,069 B2 * 9/2009 Oh ..... G02F 1/136286 349/103
8,456,406 B2 * 6/2013 Nam ..... G09G 3/3648 345/100
8,830,215 B2 * 9/2014 Ono ..... G06F 3/038 345/204
8,872,748 B2 * 10/2014 Cho ..... G09G 3/3677 345/100

(Continued)

FOREIGN PATENT DOCUMENTS

KR 10-2003-0013641 2/2003
KR 10-2007-0113917 11/2007

(Continued)

*Primary Examiner* — Peter D McLoone
(74) *Attorney, Agent, or Firm* — H.C. Park & Associates, PLC

(57) ABSTRACT

A display apparatus is disclosed. The display apparatus may include a mode determining unit, which determines an operation mode of the display apparatus between a first mode and a second mode; a display unit, which includes n scan lines including first through nth scan lines; data lines; and pixels, wherein a pixel is associated with a respective scan line and a respective data line; a gate driver to output scan signals to the scan lines; and a source driver to output data signals to the data lines in synchronization with the scan signals, wherein the gate driver substantially simultaneously outputs the scan signals to an ith scan line and a (k+i)th scan line among the scan lines in the first mode, and k is a positive integer, n is equal to 2k, and i is a positive integer smaller than or equal to k.

16 Claims, 8 Drawing Sheets

(56) References Cited

U.S. PATENT DOCUMENTS 8,952,942 B2 * 2/2015 Chae ..... H04N 13/0434 345/204
8,957,835 B2 * 2/2015 Hoellwarth ..... G02B 27/017 345/8
9,111,490 B2 * 8/2015 Ra ..... G09G 3/3266
9,324,281 B2 * 4/2016 Hwang ..... G09G 3/348
9,377,626 B2 * 6/2016 Lyons ..... G02B 27/0172
9,378,693 B2 * 6/2016 Kim ..... G09G 3/3611
9,429,759 B2 * 8/2016 Hoellwarth ..... G02B 27/017
9,482,869 B2 * 11/2016 Hoellwarth ..... G02B 27/017
2004/0201544 A1 10/2004 Love et al.
2006/0197882 A1 * 9/2006 Oh ..... G02F 1/136286 349/43
2008/0030435 A1 2/2008 Kim
2009/0213056 A1 * 8/2009 Nam ..... G09G 3/3648 345/90
2009/0327777 A1 12/2009 Vasquez et al.
2010/0045784 A1 * 2/2010 Okazaki ..... H04N 13/0029 348/55
2010/0079356 A1 * 4/2010 Hoellwarth ..... G02B 27/017 345/8
2010/0134451 A1 * 6/2010 Cho ..... G09G 3/3677 345/205
2011/0273408 A1 * 11/2011 Ra ..... G09G 3/3266 345/204
2012/0013656 A1 * 1/2012 Chae ..... H04N 13/0434 345/694
2012/0242657 A1 * 9/2012 Asano ..... G09G 3/003 345/419
2013/0009938 A1 * 1/2013 Hwang ..... G09G 3/348 345/212
2014/0009447 A1 * 1/2014 Kim ..... G09G 3/3611 345/204
2015/0198811 A1 * 7/2015 Hoellwarth ..... G02B 27/017 345/8
2015/0235426 A1 * 8/2015 Lyons ..... G02B 27/0172 345/8
2015/0243212 A1 * 8/2015 Lee ..... G09G 3/3216 345/212
2015/0348327 A1 * 12/2015 Zalewski ..... G06F 3/01 345/419
2015/0379952 A1 * 12/2015 Lee ..... G09G 3/3648 345/92
2016/0055680 A1 * 2/2016 Kim ..... G06F 3/012 345/633
2016/0062125 A1 * 3/2016 Baek ..... G02B 27/0176 361/679.01
2016/0063919 A1 * 3/2016 Ha ..... G02B 27/017 345/156
2016/0078834 A1 * 3/2016 Hong ..... G09G 3/20 345/212
2016/0085076 A1 * 3/2016 Hoellwarth ..... G02B 27/017 455/566
2016/0259169 A1 * 9/2016 Smith ..... G02B 3/08

FOREIGN PATENT DOCUMENTS

KR 10-2008-0012630 2/2008
KR 10-2010-0003242 1/2010
KR 10-1006330 1/2011

* cited by examiner

DISPLAY APPARATUS OUTPUTTING SCAN SIGNALS IN FIRST AND SECOND MODE

CROSS REFERENCE TO RELATED APPLICATION

This application claims priority from and the benefit of Korean Patent Application No. 10-2014-0145395, filed on Oct. 24, 2014, which is hereby incorporated by reference for all purposes as if fully set forth herein.

BACKGROUND

Field

Exemplary embodiments relate to display apparatuses.

Description

A display apparatus may produce images using scanning. Various constraints preclude reduction in the time associated with scanning. For example, the frequency for driving a display area in a display apparatus operating under a high resolution may be limited. If a display area is not driven at a high enough frequency, image deterioration can occur. For example, when black frames are inserted to reduce motion blur of a displayed image, flickers may be visible when the black frame insertion technique is used.

The above information disclosed in this Background section is only for enhancement of understanding of the background of the inventive concept, and, therefore, it may contain information that does not form the prior art that is already known in this country to a person of ordinary skill in the art.

SUMMARY

Exemplary embodiments include a method of driving a display apparatus at a high frequency and a method of inserting a black frame without visible flicker.

Additional aspects will be set forth in part in the description which follows and, in part, will be apparent from the description, or may be learned by practice of the presented embodiments.

According to exemplary embodiments, a display apparatus may comprise: a mode determining unit to determine an operation mode of the display apparatus between a first mode and a second mode; a display unit, comprising: n scan lines comprising first through nth scan lines; data lines; and pixels, wherein a pixel is associated with a respective scan line and a respective data line; a gate driver to output scan signals to the scan lines; and a source driver to output data signals to the data lines in synchronization with the scan signals, wherein the gate driver substantially simultaneously outputs the scan signals to an ith scan line and a (k+i)th scan line among the scan lines in the first mode, and k is a positive integer, n is equal to 2k, and i is a positive integer smaller than or equal to k.

According to exemplary embodiments, a display apparatus may include a mode determining unit to determine an operation mode of the display apparatus between a first mode and a second mode; a display unit, which comprises: scan lines; data lines; pixels, wherein a pixel is associated with a respective scan line and a respective data line; and a first display area in a first direction and a second display area in a second direction, the second direction being opposite to the first direction; a gate driver to output scan signals to the scan lines; and a source driver to output data signals to the data lines in synchronization with the scan signals, wherein an image displayed in the first area and an image displayed in the second area are substantially identical to each other in the first mode, and an image displayed in the first area and an image display in the second area include different image data in the second mode.

The foregoing general description and the following detailed description are exemplary and explanatory and are intended to provide further explanation of the claimed subject matter.

BRIEF DESCRIPTION OF THE DRAWINGS

The accompanying drawings, which are included to provide a further understanding of the inventive concept, and are incorporated in and constitute a part of this specification, illustrate exemplary embodiments of the inventive concept, and, together with the description, serve to explain principles of the inventive concept.

DETAILED DESCRIPTION OF THE ILLUSTRATED EMBODIMENTS

Figure 1:
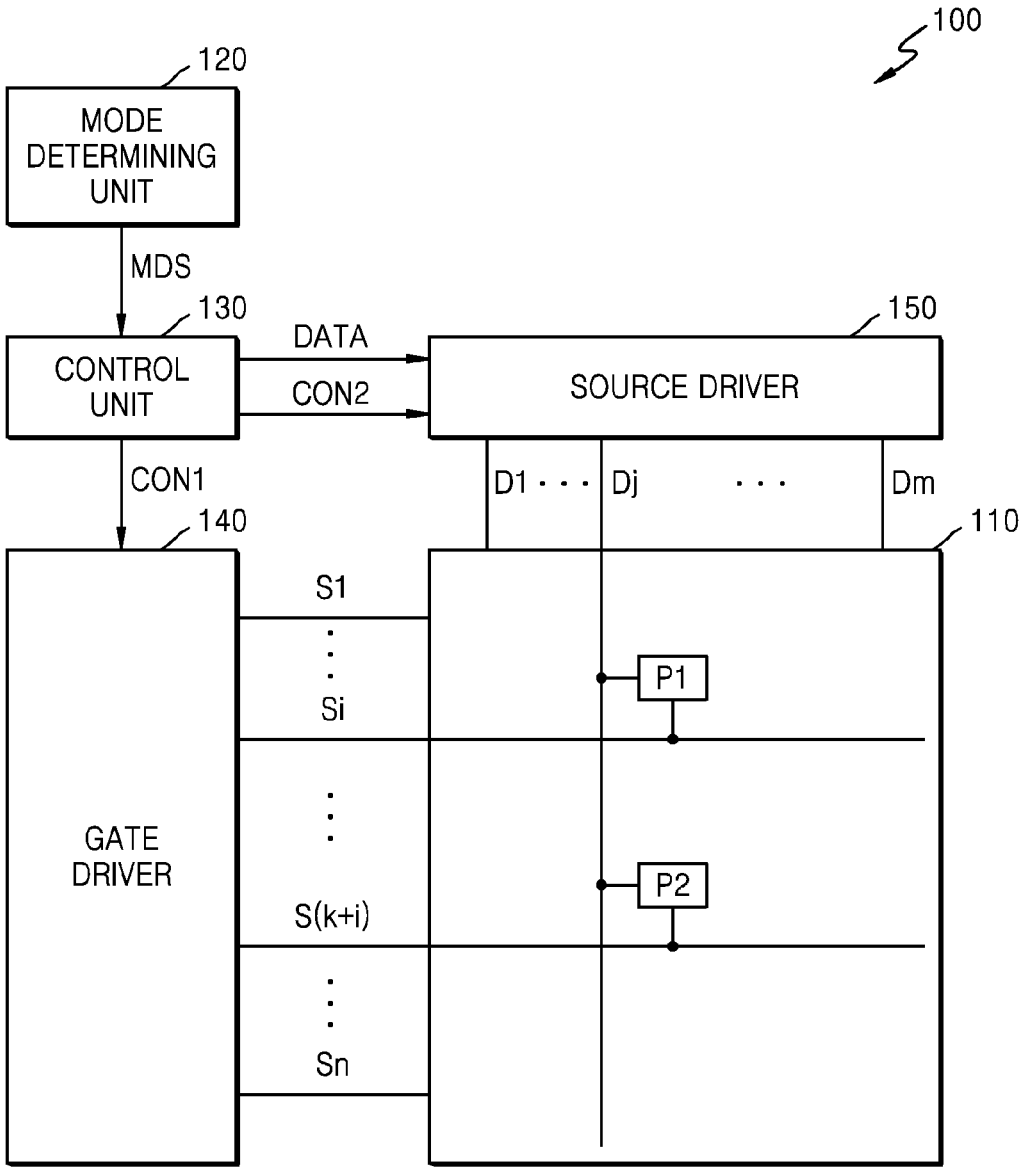
FIG. 1 is a schematic block diagram showing a display apparatus, according to one or more exemplary embodiments.

In the following description, for the purposes of explanation, numerous specific details are set forth in order to provide a thorough understanding of various exemplary embodiments. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments.

In the accompanying figures, the size and relative sizes of layers, films, panels, regions, etc., may be exaggerated for clarity and descriptive purposes. Also, like reference numerals denote like elements.

When an element or layer is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. Like numbers refer to like elements throughout. As used herein, the term "and/or" includes any and all combinations of one or more of the associated listed items.

Although the terms first, second, etc. may be used herein to describe various elements, components, regions, layers, and/or sections, these elements, components, regions, layers, and/or sections should not be limited by these terms. These terms are used to distinguish one element, component, region, layer, and/or section from another element, component, region, layer, and/or section. Thus, a first element, component, region, layer, and/or section discussed below could be termed a second element, component, region, layer, and/or section without departing from the teachings of the present disclosure.

Spatially relative terms, such as "beneath," "below," "lower," "above," "upper," and the like, may be used herein for descriptive purposes, and, thereby, to describe one element or feature's relationship to another element(s) or feature(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof.

Various exemplary embodiments are described herein with reference to sectional illustrations that are schematic illustrations of idealized exemplary embodiments and/or intermediate structures. As such, variations from the shapes of the illustrations as a result, for example, of manufacturing techniques and/or tolerances, are to be expected. Thus, exemplary embodiments disclosed herein should not be construed as limited to the particular illustrated shapes of regions, but are to include deviations in shapes that result from, for instance, manufacturing. Thus, the regions illustrated in the drawings are schematic in nature and their shapes are not intended to illustrate the actual shape of a region of a device and are not intended to be limiting.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and will not be interpreted in an idealized or overly formal sense, unless expressly so defined herein.

FIG. 1 is a schematic block diagram of display apparatus 100 according to one or more exemplary embodiment.

Referring to FIG. 1, display apparatus 100 may include a display unit 110, mode determining unit 120, control unit 130, gate driver 140, and source driver 150. Mode determining unit 120, control unit 130, gate driver 140, and source driver 150 may be either respectively located on separate semiconductor chips or contained in a single semiconductor chip. Gate driver 140 and source driver 150 may be located on a same substrate as display unit 110.

Display apparatus 100 includes the structure and circuitry for displaying an image. Display apparatus 100 may be, for example, an electronic device, such as a smart phone, a tablet PC (personal computer), a laptop PC, a monitor, and a TV, or associated with the below-stated electronic devices for displaying images. The following description will be focus at times under the assumptions that display apparatus 100 is a smart phone, and that the smartphone has an OLED display apparatus. Display apparatus 100 may operate in a first mode or a second mode.

Display unit 110 may display an image. Display unit 110 may be a flat-panel display apparatus, such as an organic light emitting diode (OLED) display apparatus, a thin-film transistor liquid crystal display (TFT-LCD) apparatus, a plasma display panel (PDP) display apparatus, or a light emitting diode (LED) display apparatus. However, display unit 110 is not limited thereto and may be any of various apparatuses that receive image signals and output images corresponding thereto. Display unit 110 may include a first through nth scan lines S1 through Sn, a first through mth data lines D1 through Dm, and a plurality of pixels P1 and P2 connected to each other via the plurality of scan lines and the plurality of data lines. FIG. 1 shows only two pixels P1 and P2 in the display unit 110, however, the inventive concept is not limited thereto, and a pixel may be arranged at each location where the first through nth scan lines S1 through Sn and the first through mth data lines D1 through Dm cross.

Mode determining unit 120 may output a mode determining signal to decide one of a first mode and a second mode as an operation mode of display apparatus 100 to control unit 130. However, mode determining unit 120 is not limited thereto and may make determinations among the use of three or greater modes. Mode determining unit 120 may output mode determining signal MDS based on, for example, an input from a user of display apparatus 100. For example, when display apparatus 100 is currently operating in a second mode and a user inputs a particular command to display apparatus 100, mode determining unit 120 may switch the operation mode of display apparatus 100 to a first mode by using mode determining signal MDS.

Control unit 130 may output control signals CON including first and second control signals CON1 and CON2 and image data DATA based on mode determining signal MDS. Control unit 130 may output a first control signal CON1 to gate driver 140. Control unit 130 may output image data DATA and second control signal CON2 to source driver 150.

First control signal CON1 may have different frequencies based on operation modes of display apparatus 100. For example, frequency of the first control signal may be 2C Hz when display apparatus 100 operates in a first mode, whereas frequency of the first control signal may be C Hz when display apparatus 100 operates in a second mode. The first control signal may be a vertical synchronization signal that defines one frame time. For example, if frequency of the first control signal is 2C Hz, one frame time may correspond to 1/(2C) seconds.

Second control signal CON2 may have a different numbers of pulses during one frame period based on operation modes of display apparatus 100. For example, the second control signal may have k pulses for one frame period when display apparatus 100 operates in a first mode, whereas the second control signal may have 2k pulses for one frame period when display apparatus 100 operates in a second mode. The second control signal may be a horizontal synchronization signal for defining a time period for displaying an image in a single row. In this case, based on a number of pulses that a second control signal has for one frame period, a number of rows of display unit 110 for displaying different image data for one frame time may be determined. For example, if the second control signal has k pulses for one frame time, display unit 110 may include k rows that display different image data, respectively. The second control signal may be synchronized with the first control signal. For example, if a rising edge occurs in the first control signal, a pulse may appear in the second control signal at the time of or a designated time period after the occurrence of the rising edge.

Gate driver 140 may output a plurality of scan signals to pixels of display unit 110 via first through nth scan lines S1 through Sn. For example, if a rising edge occurs in the first control signal, a first scan signal may be output to a first scan line S1 at the time of or a designated time period after the occurrence of the rising edge. The number of scan lines may be a positive integer which is a multiple of 2, but aspects of the invention are not limited thereto.

When display apparatus 100 operates in a first mode, gate driver 140 may output scan signals simultaneously to an ith scan signal (Si) and (k+i)th scan line (S(k+i)). k may be n/2 (for example, in a display with 720 scan lines, k could be 360). "i" may be a positive integer below or equal to k. As a result, a first image displayed by pixels connected to first through kth scan lines (S1 through Sk) and a second image displayed by pixels connected to (k+1)th through nth scan lines (S(k+1) through Sn) may be identical to each other.

When display apparatus 100 operates in a second mode, gate driver 140 may output scan signals sequentially to the first through nth scan lines S1 through Sn. As a result, a first image displayed by pixels connected to first through kth scan lines S1 through Sk and a second image displayed by pixels connected to (k+1)th through nth scan lines S(k+1) through Sn may be independent from each other.

Source driver 150 may output a plurality of data signals via first through mth data lines D1 through Dm in synchronization with scan signals. Source driver 150 may output data signals based on a second control signal. For example, if a rising edge occurs in the second control signal, data signals may be output to the first through nth scan lines S1 through Sn at the time of or a designated time period after the occurrence of the rising edge.

Sizes of frame data corresponding to images to be displayed by display unit 110 during one frame period may differ from one another based on operation modes of display apparatus 100. For example, when display apparatus 100 operates in a first mode, a second control signal may include k pulses for one frame time, and m data signals may be output via m data lines for each pulse of the second control signal. In this case, when one data signal is 8-bits, the size of the frame data may be (k*m*8). When display apparatus 100 operates in a second mode, a second control signal may include 2k pulses for one frame time, and m data signals may be output via m data lines for each pulse of the second control signal. In this case, when one data signal is 8-bits, size of frame data may be (2*k*m*8), and the size of frame data in the second mode may be twice as large as size of frame data in the first mode.

Figure 2:
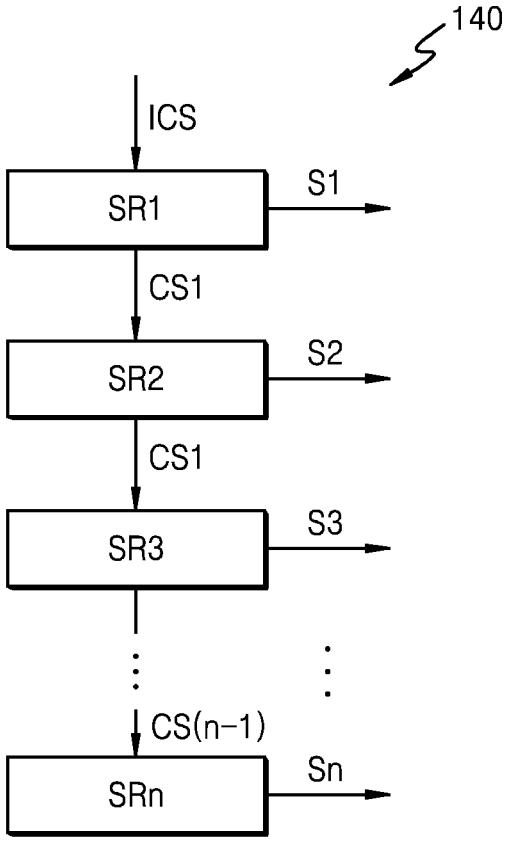
FIG. 2 is a schematic block diagram showing a gate driver in FIG. 1, according to one or more exemplary embodiments.

FIG. 2 is a schematic block diagram showing a gate driver in FIG. 1, according to one or more exemplary embodiments.

Referring to FIG. 2, gate driver 140 may include first through nth shift registers SR1 through SRn. The first through nth shift registers SR1 through SRn may output first through nth scan signals via the first through nth scan lines S1 through Sn, respectively.

Gate driver 140 may sequentially output first through nth scan signals. For example, in response to an initial control signal ICS, a first shift register SR1 may output first scan signal to pixels located at the first row of display unit 110 via the first scan line S1 and output a first shift control signal CS1 to a second shift register SR2. In response to the first shift control signal CS1, the second shift register SR2 may output a second scan signal to pixels located at the second row of the display unit 110 and output a second shift control signal CS2 to a third shift register SR3. The gate driver 140 may perform a scan the first through nth scan lines S1 through Sn in a first direction (a direction from the first scan line S1 to the nth scan line Sn).

When display apparatus 100 operates in a first mode, ith shift register SRi and (k+i)th shift register SR(k+i) may be simultaneously activated. For example, when kth shift register SRk outputs a kth scan signal to pixels at the kth row of display unit 110 via kth scan line Sk in response to (k−1)th shift control signal CS(k−1), the first shift register SRi may simultaneously output a first scan signal to pixels at the first row of display unit 110 via the first scan line S1 in response to the initial control signal ICS. The ith shift register SRi and the (k+i)th shift register SR(k+i) may simultaneously output an ith scan signal and a (k+i)th scan signal via ith scan line Si and (k+i)th scan line S(k+i), respectively. As a result, a first image displayed by pixels connected to first through kth scan lines S1 through Sk and a second image displayed by pixels connected to (k+1)th through nth scan lines S(k+1) through Sn may be identical to each other.

Figure 3A:
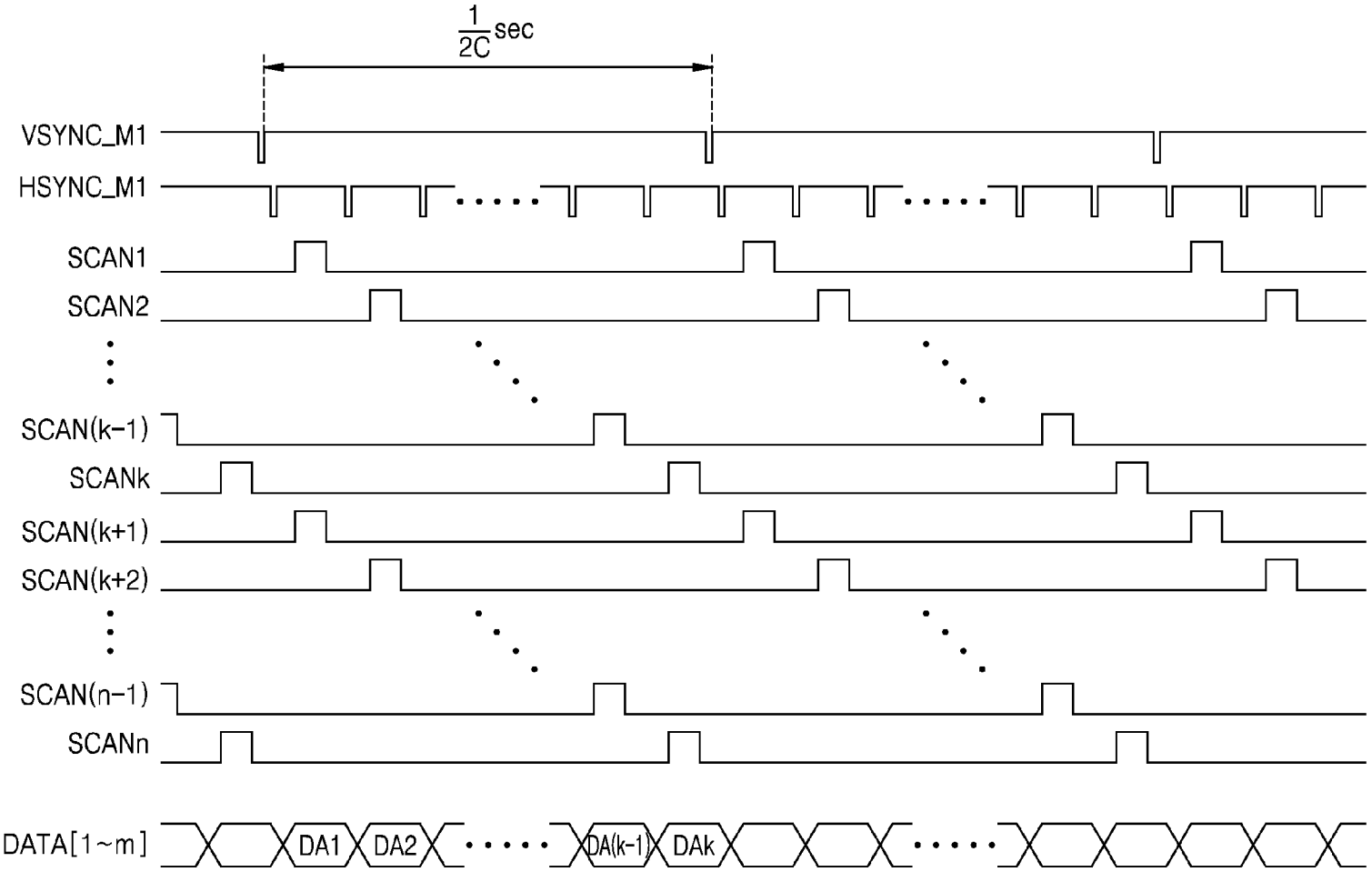
FIG. 3A is a schematic timing diagram of the display apparatus of FIG. 1 operating in a first mode, according to one or more exemplary embodiments.

FIG. 3A is an exemplary schematic timing diagram showing of display apparatus 100 in FIG. 1 operating in a first mode.

Referring to FIG. 3A, when display apparatus 100 operates in the first mode, a first control signal and a second control signal may be a first vertical synchronization signal VSYNC_M1 and a first horizontal synchronization signal HSYNC_M1, respectively.

One frame period may be a time period from a time point at which one rising edge occurs to a time point at which a next rising edge occurs, in the first vertical synchronization signal VSYNC_M1. For example, when display apparatus 100 operates in the first mode, one frame period may be 1/(2C) seconds, as shown in FIG. 3A, and frequency of the first vertical synchronization signal VSYNC_M1 may be 2C Hz. If a rising edge occurs in the first vertical synchronization signal VSYNC_M1, a first scan signal SCAN1 may be output to the first scan line S1 at the time of or a designated time period after the occurrence of the rising edge. A second scan signal SCAN2 may be output a designated time period after the first scan signal SCAN1 is output. The first through nth scan signals SCAN1 through SCANn may be sequentially output.

During one frame period, the first horizontal synchronization signal HSYNC_M1 may have k pulses, a first through k pulses. When a rising edge occurs at the ith pulse of the first horizontal synchronization signal HSYNC_M1 or at a designated time period after the occurrence of the rising edge, data signals DAi[1] through DAi[m] to be input to pixels at the ith row may be output to the first through mth data lines D1 through Dm. Furthermore, pulses of the first horizontal synchronization signal HSYNC_M1 may be synchronized with the first through nth scan signals SCAN1 through SCANn. For example, as shown in FIG. 3A, a rising edge of the ith scan signal SCANi may occur after a rising edge of the ith pulse of the first horizontal synchronization signal HSYNC_M1 occurs, and a falling edge of the ith scan signal SCANi may occur before a falling edge of the ith pulse of the first horizontal synchronization signal HSYNC_M1 occurs. As a result, the falling edge of the ith scan signal SCANi may occur while the data signals DAi[1] through DAi[m] to be input to pixels at the ith row are being output to the first through mth data lines D1 through Dm. Therefore, the data signals DAi[1] through DAi[m] to be input to pixels at the ith row of the display unit 110 may be correctly input to the pixels at the ith row.

When display apparatus 100 operates in a first mode, scan signals may be simultaneously output to the ith scan line Si and the (k+i)th scan line S(k+i). As a result, a first image displayed by pixels connected to first through kth scan lines S1 through Sk and a second image displayed by pixels connected to (k+1)th through nth scan lines S(k+1) through Sn may be identical to each other.

Figure 3B:
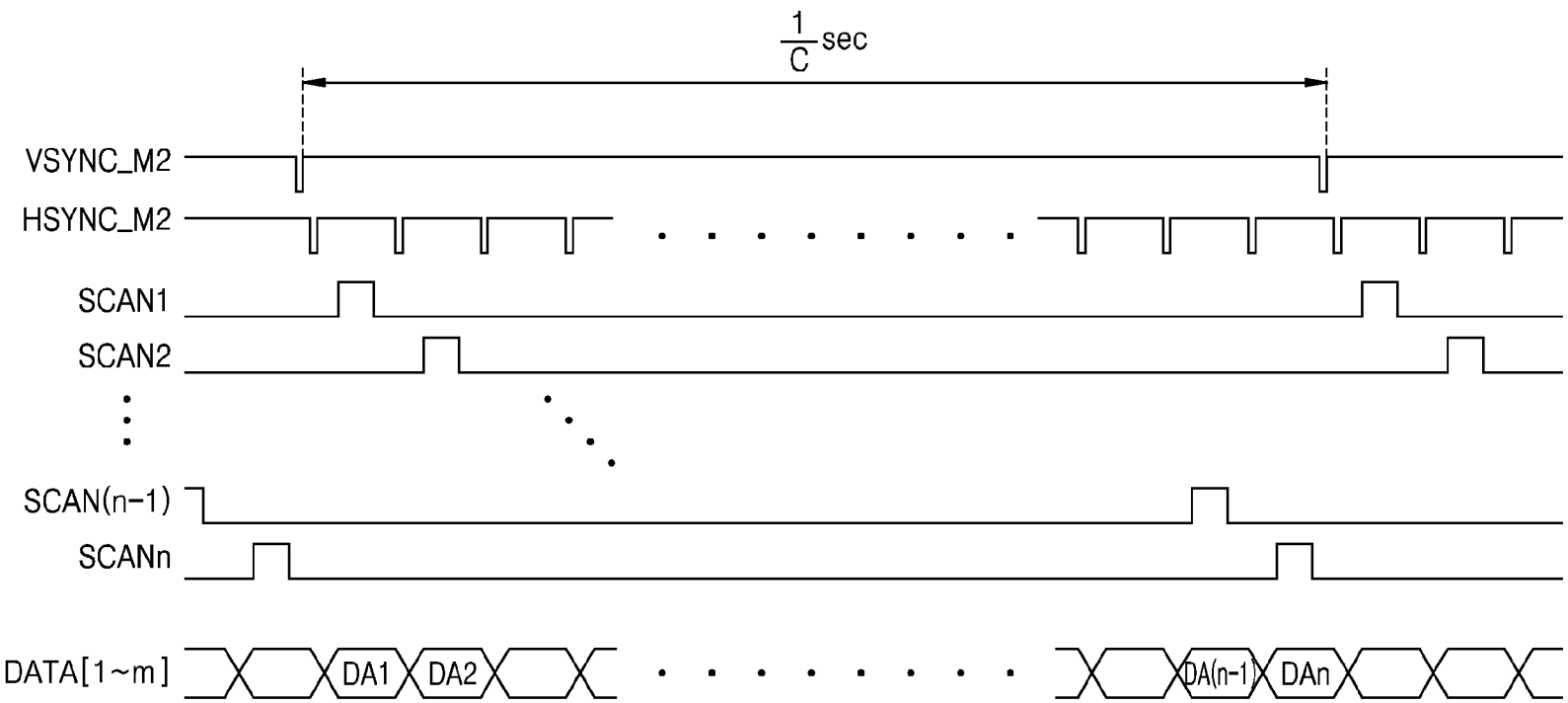
FIG. 3B is a schematic timing diagram of the display apparatus of FIG. 1 operating in a second mode, according to one or more exemplary embodiments.

FIG. 3B is a second mode.

Referring to FIG. 3B, when display apparatus 100 operates in the second mode, a first control signal and a second control signal may be a second vertical synchronization signal VSYNC_M2 and a second horizontal synchronization signal HSYNC_M2, respectively.

When display apparatus 100 operates in the second mode, one frame time may be 1/C seconds, as shown in FIG. 3B. As a result, frequency of the second vertical synchronization signal VSYNC_M2 may be C Hz. Frequency of the first vertical synchronization signal VSYNC_M1 as shown in FIG. 3A may be twice as high as frequency of the second vertical synchronization signal VSYNC_M2 as shown in FIG. 3B.

During one frame period, second horizontal synchronization signal HSYNC_M2 may have 2k pulses, a first through 2k pulses. When display apparatus 100 operates in the second mode, all of the first through nth scan lines S1 through Sn may sequentially output scan signals. As a result, a first image displayed by pixels connected to first through kth scan lines S1 through Sk and a second image displayed by pixels connected to (k+1)th through nth scan lines S(k+1) through Sn may be independent from each other.

As illustrated in FIGS. 3A and 3B, output of data signals to be input to pixels at the first row of a next frame period may begin immediately after output of data signals to be input to pixels at an nth row of one frame period. However, the inventive concept is not limited thereto, and there may be a predetermined wait time between a time point at which output of data signals to be input to pixels at the nth frame of one frame period ends and a time point at which output of data signals to be input to pixels at the first row of a next frame period begins.

Figure 4A:
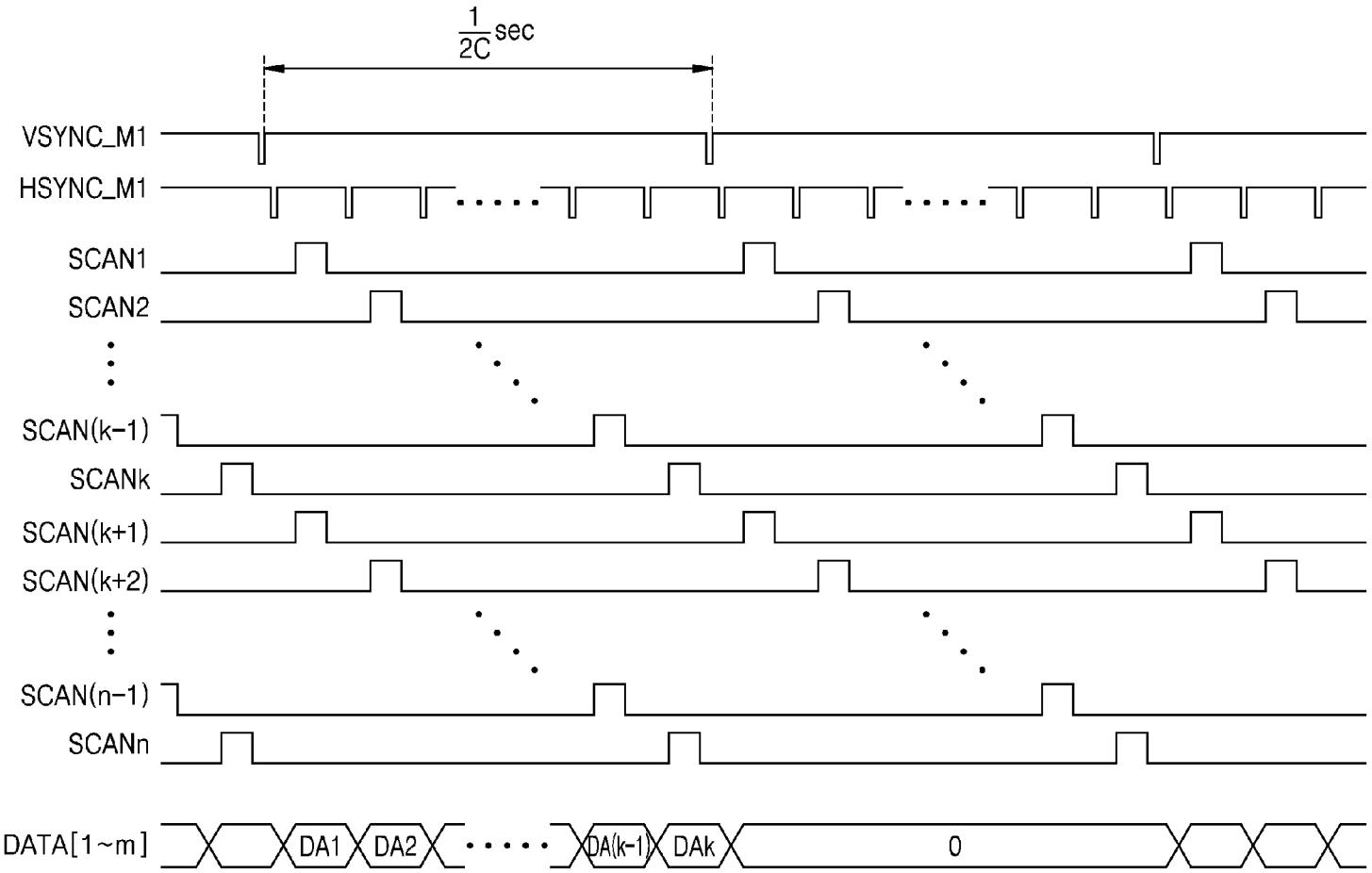
FIGS. 4A and 4B are schematic timing diagrams of the display apparatus of FIG. 1 operating in a first mode in which black frames area added, according to one or more exemplary embodiments.
Figure 4B:
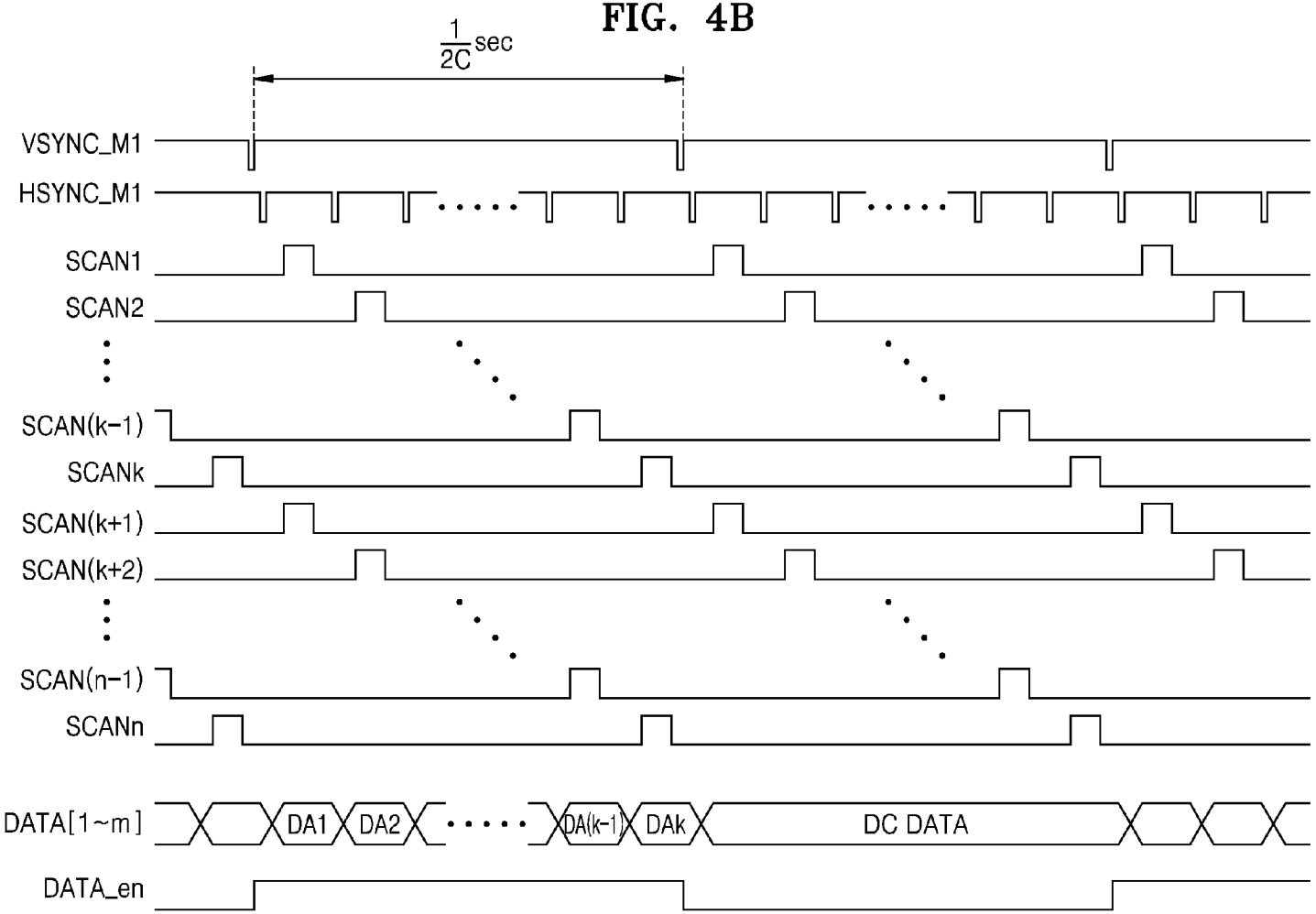

FIGS. 4A and 4B are schematic timing diagrams of a display apparatus of FIG. 1 operating in a first mode in which black frames area added, according to one or more exemplary embodiments.

Referring to FIGS. 4A and 4B, when display apparatus 100 operates in a first mode, display unit 110 may display an image frame for one of the two frame periods and display a black frame for the other one of the two frame periods. The image frame may be a frame displaying images a user wants to view, whereas the black frame refers to a frame displaying all black data, such that images to be displayed by display unit 110 for one frame period are all black data.

Control unit 130 may alternately output image frame data and black frame data in synchronization with the first vertical synchronization signal VSYNC_M1. As shown in FIG. 4A, the first through mth data lines D1 through Dm may output data signals indicating 0 for one of the two frame periods. As a result, a black frame may be displayed for one of two frame periods. As shown in FIG. 4B, a data enable signal DATA_en may have a value of 1 for one of the two frame periods and may have a value of 0 for the other one of the two frame periods. Furthermore, a driving transistor included in each pixel may apply a driving current to a light emitting device included in each pixel only when value of the data enable signal DATA_en is 1. As a result, a black frame may be displayed for one of the two frame periods.

When display apparatus 100 operates in the second mode, frequency of the second vertical synchronization signal VSYNC_M2 is C Hz. Since there are constraints for reducing scan time of the display apparatus 100, making driving display unit 110 in a high-resolution OLED display apparatus at 120 Hz difficult, C may be smaller than 120 Hz. When display apparatus 100 operating in the second mode displays a black frame for one of the two frame periods, less than 60 image frames may be displayed in display unit 110 for one second, which may result in a visible flicker.

When display apparatus 100 operates in a first mode, frequency of the first vertical synchronization signal VSYNC_M1 is 2C Hz, and thus 2C images may be displayed in display unit 110 for one second. Since display unit 110 may be driven at a frequency higher than 60 Hz in a high-resolution OLED display apparatus, 2C may be equal to or greater than 120 Hz. Therefore, when display apparatus 100 operating in the first mode displays a black frame for one of the two frame periods, more than 60 image frames may be displayed in display unit 110 for one second, which may reduce the possibility of visible flicker.

Figure 5A:
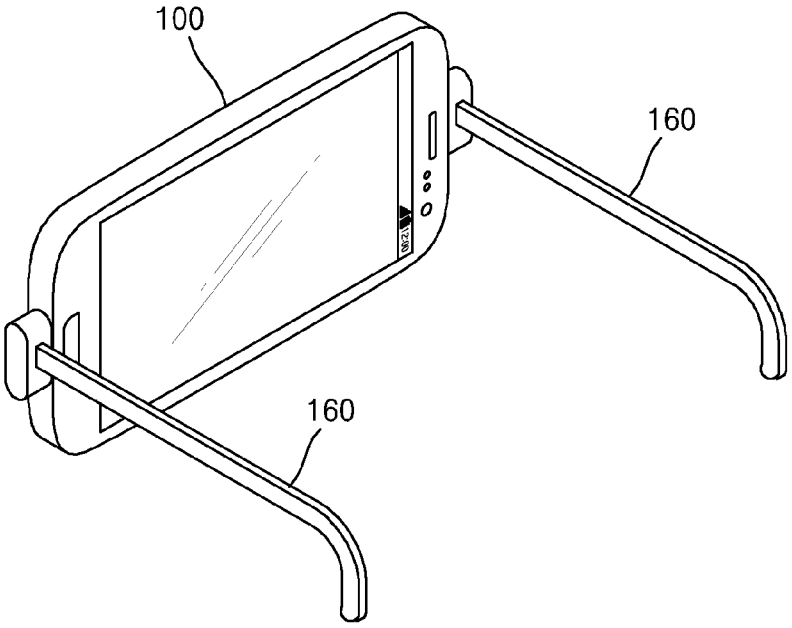
FIGS. 5A, 5B, and 5C are schematic diagrams of a display apparatus fixing unit for a display apparatus, according to one or more exemplary embodiments.
Figure 5B:
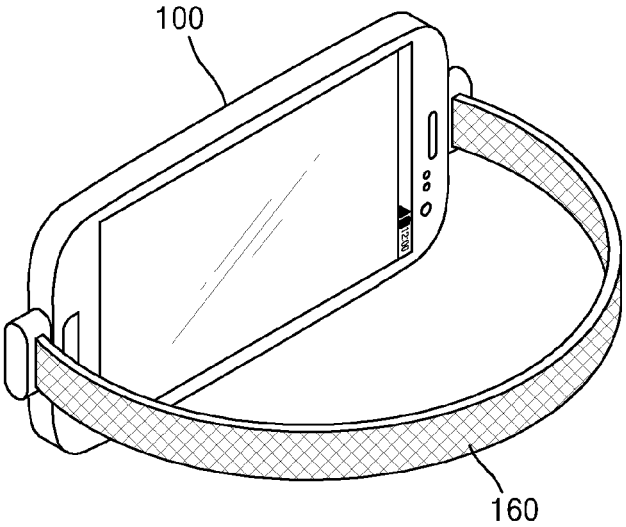
Figure 5C:
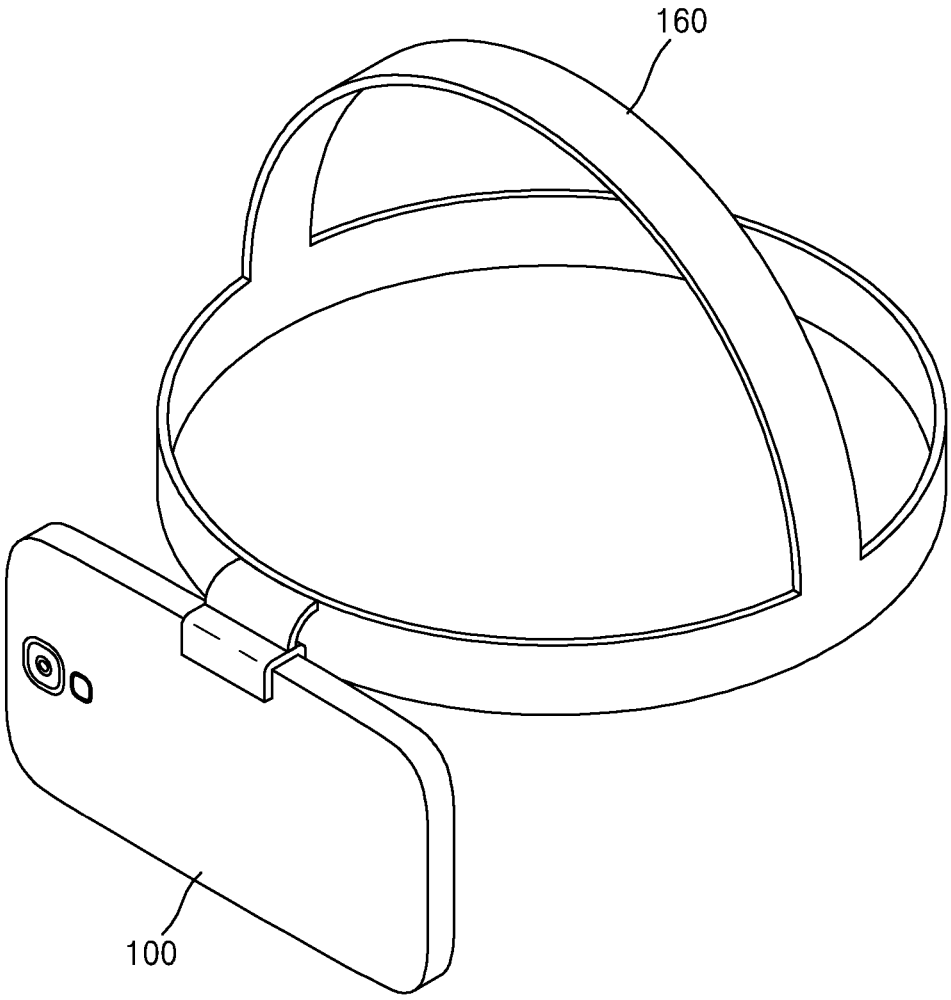

FIGS. 5A, 5B, and 5C are schematic diagrams of a display apparatus fixing unit for a display apparatus, according to one or more exemplary embodiments.

Referring to FIGS. 5A, 5B, and 5C, display apparatus 100 may include various display apparatus fixing units 160. Display apparatus fixing unit 160 may fix display apparatus 100 to the head of a user, such that display unit 110 of display apparatus 100 is fixed in front of both eyes of a user. Display apparatus fixing unit 160 may have a shape similar to an eyeglass frame, as shown in FIG. 5A. Display apparatus fixing unit 160 may have a shape similar to a hair band, as shown in FIG. 5B. Display apparatus fixing unit 160 may have a shape similar to a helmet, as shown in FIG. 5C. Display apparatus fixing unit 160 may include an optical system.

A first image displayed by pixels connected to first through kth scan lines S1 through Sk may be seen by the left eye of a user, whereas a second image displayed by pixels connected to (k+1)th through nth scan lines S(k+1) through Sn may be seen by the right eye of the user. If display apparatus 100 operates in a first mode, the first image and the second image may be identical to each other, and a user may view high frequency images. If display apparatus 100 operates in a first mode in which black frames are added, the user may view images with reduced motion blur without noticeable flicker.

As described above, according to exemplary embodiments, a display apparatus may be driven at a high frequency.

A black frame inserting technique for preventing or reducing flickers from being visible may be applied to a display apparatus according to an exemplary embodiment.

It should be understood that the exemplary embodiments described therein should be considered in a descriptive sense only and not for purposes of limitation. Descriptions of features or aspects within each embodiment should typically be considered as available for other similar features or aspects in other embodiments.

Although certain exemplary embodiments and implementations have been described herein, other embodiments and modifications will be apparent from this description. Accordingly, the inventive concept is not limited to such embodiments, but rather to the broader scope of the presented claims and various obvious modifications and equivalent arrangements.

What is claimed is:

1. A display apparatus comprising:

a mode determining unit to determine an operation mode of the display apparatus between a first mode and a second mode;

a display unit, comprising:

n scan lines comprising first through nth scan lines;

data lines; and pixels, wherein a pixel is associated with a respective scan line and a respective data line;

a gate driver to output scan signals to the scan lines;

a source driver to output data signals to the data lines in synchronization with the scan signals; and a control unit outputting a first control signal, a second control signal, and an image data according to the operation mode, wherein:

the gate driver substantially simultaneously outputs the scan signals to an ith scan line and a (k+i)th scan line among the scan lines in the first mode;

the gate driver outputs the scan signals corresponding to the first control signal defining one frame period;

the source driver outputs data signals corresponding to the image data generated from the second control signal synchronized with the first control signal;

during one frame period, the second control signal comprises k pulses in the first mode and comprises 2k pulses in the second mode; and k is a positive integer, n is equal to 2k, and i is a positive integer smaller than or equal to k.

2. The display apparatus of claim 1, wherein a first image displayed by pixels connected to first through kth scan lines and a second image displayed by pixels connected to (k+1)th through nth scan lines are identical to each other.

3. The display apparatus of claim 1, wherein the gate driver sequentially outputs the scan signals to the scan lines in the second mode, wherein, in the second mode, a first image displayed by pixels connected to first through kth scan lines and a second image displayed by pixels connected to (k+1)th through nth scan lines include different image data.

4. The display apparatus of claim 1, wherein the image data comprises frame data corresponding to images to be displayed by the display unit per frame period, and size of frame data in the second mode is twice as large as size of frame data in the first mode.

5. The display apparatus of claim 1, wherein, in the first mode, the display unit displays a black frame for one of the two frame periods.

6. The display apparatus of claim 5, wherein, in the first mode, the control unit alternately outputs image frame data and black frame data in synchronization with the first control signal.

7. The display apparatus of claim 1, wherein the control unit outputs a first control signal of a first frequency to the gate driver in the first mode, the control unit outputs a first control signal of a second frequency to the gate driver in the second mode, the first frequency being twice as high as the second frequency.

8. The display apparatus of claim 7, wherein the second frequency is higher than 60 Hz and lower than 120 Hz.

9. The display apparatus of claim 1, wherein the gate driver comprises n shift registers respectively connected to the n scan lines, wherein in the first mode, an ith shift register and a (k+i)th shift register are substantially simultaneously activated.

10. The display apparatus of claim 1, further comprising a display apparatus fixing unit to mount the display apparatus to be positioned in front of both eyes of a user.

11. The display apparatus of claim 10, wherein the display apparatus fixing unit mounts the display apparatus, such that a first image displayed by pixels connected to first through kth scan lines is seen by the left eye of the user and a second image displayed by pixels connected to (k+1)th through nth scan lines is seen by the right eye of the user.

12. A display apparatus comprising:

a mode determining unit to determine an operation mode of the display apparatus between a first mode and a second mode;

a display unit comprising:

scan lines comprising first through nth scan lines;

data lines;

pixels, wherein a pixel is associated with a respective scan line and a respective data line; and a first display area in a first direction and a second display area in a second direction, the second direction being opposite to the first direction;

a gate driver to output scan signals to the scan lines; and a source driver to output data signals to the data lines in synchronization with the scan signals; and a control unit to output a vertical synchronization signal of a first frequency to the gate driver in the first mode and to output a vertical synchronization signal of a second frequency to the gate driver in the second mode, the second frequency being ½ of the first frequency, wherein:

the first display area comprises pixels respectively connected to the first through kth scan lines;

the second display area comprises pixels respectively connected to the (k+1)th through nth scan lines;

an image displayed in the first display area and an image displayed in the second display area are substantially identical to each other in the first mode;

an image displayed in the first display area and an image displayed in the second display area include different image data in the second mode; and k is a positive integer, n is equal to 2k, and i is a positive integer smaller than or equal to k.

13. The display apparatus of claim 12, wherein the gate driver simultaneously outputs the scan signals to an ith scan line and a (k+i)th scan line from among the scan lines in the first mode, wherein, in the first mode, a pixel connected to a (k+i)th scan line and a first data line simultaneously receives the data signal identical to a data signal received by a pixel connected to an ith scan line and the first data line.

14. The display apparatus of claim 12, wherein the gate driver comprises first to nth shift registers respectively connected to the first to nth scan lines, wherein, in the first mode, an ith shift register and a (k+i)th shift register are simultaneously activated.

15. The display apparatus of claim 12, wherein the control unit outputs image data comprising black frames added between image frames, to the source driver in synchronization with the vertical synchronization signal of the first frequency in the first mode.

16. The display apparatus of claim 12, further comprising a display apparatus fixing unit to mount the display apparatus for the user, wherein an image displayed at the first display area is seen by the left eye of a user and an image displayed at the second display area is seen by the right eye of the user.

* * * * *